US005950536A

United States Patent [19]

Erbstein

[11] Patent Number: 5,950,536

[45] Date of Patent: Sep. 14, 1999

[54] VARIABLE CUTOFF OFFSET PRESS UNIT

[75] Inventor: Bob Erbstein, Naples, Fla.

[73] Assignee: Imprimeries Transcontinental, Inc., Montreal, Canada

[21] Appl. No.: 09/234,605

[22] Filed: Jan. 21, 1999

[30] Foreign Application Priority Data

Jan. 23, 1998 [CA] Canada ..... 2224762

[51] Int. Cl.[6] ..... B41F 7/12; B41F 13/44

[52] U.S. Cl. ..... 101/177

[58] Field of Search ..... 101/177, 178, 101/179, 180, 181, 220, 221, 137, 138, 142, 143, 217, 218, 144

[56] References Cited

U.S. PATENT DOCUMENTS

| | | | |
|---|---|---|---|
| 5,188,027 | 2/1993 | Fantoni | 101/216 |
| 5,215,013 | 6/1993 | Vrotacoe et al. | 101/217 |
| 5,216,953 | 6/1993 | Hada | 101/375 |
| 5,323,702 | 6/1994 | Vrotacoe et al. | 101/217 |
| 5,351,616 | 10/1994 | Gelinas et al. | 101/218 |
| 5,394,798 | 3/1995 | Simon et al. | 101/218 |
| 5,429,048 | 7/1995 | Gaffney et al. | 101/217 |
| 5,454,317 | 10/1995 | Kobler et al. | 101/477 |
| 5,553,541 | 9/1996 | Vrotacoe et al. | 101/217 |
| 5,638,754 | 6/1997 | Steinmeier et al. | 101/477 |
| 5,654,100 | 8/1997 | Köbler et al. | 428/390 |
| 5,706,725 | 1/1998 | Kolbe et al. | 101/216 |
| 5,706,731 | 1/1998 | Francille et al. | 101/375 |
| 5,813,336 | 9/1998 | Guaraldi et al. | 101/218 |

*Primary Examiner*—J. Reed Fisher
*Attorney, Agent, or Firm*—Pearson & Pearson

[57] ABSTRACT

A fixed cutoff press is adapted to a variable cutoff press while maintaining the size of the blanket cylinders. A plate cylinder is mounted on a frame and includes a plate cylinder sleeve and a blanket cylinder is mounted on the frame, includes with a gapless blanket cylinder sleeve. The gapless blanket sleeve contacts the plate cylinder sleeve at a first nip. The press has an impression plate mounted on the frame in the case of a non-perfecting press or an identical, mirror image assembly of plate and blanket cylinders in the case of a perfecting press. A material to be printed passes through a second nip. Inkers are provided for transferring an ink film to the plate cylinder sleeve, the ink pattern being subsequently transferred to the blanket cylinder sleeve at the first nip and the ink pattern being subsequently transferred from the blanket cylinder sleeve to the material to be printed at the second nip. The press also includes drivers to drive in rotation the plate cylinder and drivers to drive in rotation the blanket cylinder. A controller is provided for controlling each of the drivers so that the surface speed of the sleeve of the plate cylinder and the surface speed of the blanket cylinder sleeve are equal at the first nip. The plate cylinder sleeve is variable, whereby a length of an image to be printed is varied proportionally to the variable outer diameter while maintaining the outer diameter of the gapless blanket cylinder sleeve constant. Accordingly, since the size of the blanket is fixed and offset presses presently require changing plates for each job, changes in cutoff are made in a manner similar to today, i.e. plates but not blankets are changed for each job. Ideally, the residual ink on the blanket, once the image is transferred to the web, is small enough that a secondary image will not appear on the web. The invention also provides for the inclusion of a blanket washer or scrapper, which continually removes the residual ink and recirculates it through the ink train to avoid any secondary images.

11 Claims, 5 Drawing Sheets

( IMPRESSION 1 )

( IMPRESSION 2 )

VARIABLE CUTOFF OFFSET PRESS UNIT

FIELD OF THE INVENTION

This invention relates to a variable cutoff offset press unit, and more particularly to such a unit where the blanket cylinder has a fixed diameter, but where the diameter of the plate cylinder can vary in order to print images of different lengths with minimal intervention.

DESCRIPTION OF THE PRIOR ART

In the area of commercial printing, a variety of different techniques can be used, such as gravure printing, flexographic printing, and offset printing.

Each of these techniques basically involve the step of inking a roller and transferring the ink (which now represents an image) onto printing material, such as paper, cardboard, etc.

A typical offset printing press includes a plate cylinder, a blanket cylinder and an impression cylinder, each rotationally mounted in the press. The plate cylinder carries a printing plate having a rigid surface defining an image to be printed. The blanket cylinder carries a printing blanket having a flexible surface which contacts the printing plate at a nip between the plate cylinder and the blanket cylinder. The material to be printed travels through a second nip between the impression cylinder and the blanket cylinder. The material to be printed is sometimes called a web.

The ink required to form the image on the material to be printed is first applied to the plate cylinder, transferred to the blanket cylinder at the nip therebetween and then transferred to the material to be printed at the second nip.

This type of press is referred to as <<non-perfecting>> since only one side of the material to be printed is printed. However, <<perfecting>> presses also exist, where the impression cylinder is replaced by another assembly formed by another plate cylinder and another blanket cylinder, so that both sides of the paper are printed at the same time.

The length of the surface of the blanket cylinder (or the circumference thereof), including the printing blanket, is always a multiple of the length of the surface of the plate cylinder (of the circumference thereof), including the plate. However, should a customer require a length of an image which does not fall within this parameter, the press would not be able to image, or such an order would result in a sizable portion of paper to be wasted. For example, if the blanket circumference is 21" (or approximately 53 cm) and the plate circumference is also 21" (or approximately 53 cm), two 10.5" (or approximately 27 cm) images are handled well. If the image length is increased to 12" (or approximately 30 cm), only one image can be printed with 9" (or approximately 23 cm) of paper wasted for each revolution of the cylinders. If the image length is 22" (or approximately 56 cm), this image cannot be printed with the 21" blanket cylinder, since most blanket cylinders existing have a longitudinal slot thereon, which results in a gap in the image.

A press concept of great value to companies is that of a variable cutoff offset printing. In the current fixed cutoff environment (or more precisely, limited variation in the cutoff as described above), equipment can be made obsolete by customers changing to product sizes which don't fit the present equipment, or by press manufacturers marketing new cutoff sizes in order to stimulate sales. Furthermore, customers are showing an increased interest in a range of sizes. This trend seems driven by the increased competition in several markets, and the elimination of film as a "standardization driver" resulting from the digitization of prepress.

Should a printer want to accommodate print runs of different lengths, the printer can equip itself with a custom press of the required cutoff (i.e. diameter or circumference), which is quite expensive. Otherwise, one solution provides for a removable cassette, which includes both the plate cylinder and the blanket cylinder of the appropriate cutoff. This solution is described in U.S. Pat. No. 5,394,798. The disadvantage to this solution is that the cost of a cassette is approximately half that of a new printing unit, and requires considerable down time in order to change the cassette and perform the necessary adjustments.

Converting a typical commercial offset press system to variable cutoff further requires variable cutoff print units and folders. Pasters, infeeds, dryers and chill rollers are not affected by changes in cutoff.

It should be further noted that in commercial printing presses, the plate cylinder must be changed each time the print job is changed, whereas the blanket cylinder has a much longer usable life. Accordingly, existing presses are equipped to permit easy and fast replacement of the printing plates.

One recent advancement in offset printing is the development of a gapless blanket. Traditionally, printing blankets were formed in a flat sheet which was subsequently wrapped around the blanket cylinder. This resulted in a longitudinal gap where the two opposite ends of the flat sheet met. Such a gap caused vibration and other problems associated with high-speed printing. Accordingly, a gapless blanket was developed, as described in U.S. Pat. No. 5,429,048. This gapless blanket purports to minimize the vibrations associated with high-speed printing and is essentially a relatively flexible hollow member which can be slid over the blanket cylinder. Means are provided in the blanket cylinder to press against the gapless sleeve in order to lift it from the cylinder to permit removal thereof.

SUMMARY OF THE INVENTION

It is an object of the invention to adapt a fixed cutoff press to a variable cutoff press while maintaining the size of the blanket cylinders. Such a press includes a plate cylinder mounted on a frame and further including a plate cylinder sleeve having an outer diameter and a circumference mounted about the plate cylinder. The press also has a blanket cylinder mounted on the frame, where the blanket cylinder is parallel to the plate cylinder, the blanket cylinder being provided with a gapless blanket cylinder sleeve mounted about the blanket cylinder. The gapless blanket sleeve has a predetermined outer diameter which contacts the outer diameter of the plate cylinder sleeve at a first nip.

The press also has an impression plate mounted on the frame, where the impression plate is parallel to the plate cylinder. A material to be printed passes through a second nip between the gapless blanket cylinder sleeve and the impression cylinder. This is known as a "non-perfecting" press. A perfecting press is also contemplated by the invention, where the impression plate is replaced by another assembly formed of a plate cylinder and a blanket cylinder, identical as above but a mirror image of the first assembly about the material to be printed.

Inking means are provided for transferring an ink film to the plate cylinder sleeve, the ink pattern formed at the plate being subsequently transferred to the blanket cylinder sleeve at the first nip and the ink pattern being subsequently transferred from the blanket cylinder sleeve to the material to be printed at the second nip.

The press also includes means to drive in rotation the plate cylinder and means to drive in rotation the blanket cylinder.

Control means are further provided for controlling each of the drive means so that the surface speed of the sleeve of the plate cylinder and the surface speed of the blanket cylinder sleeve are equal at the first nip.

In accordance with the objects of the invention, the invention lies in the provision of a variable outer diameter plate cylinder sleeve, whereby a length of an image to be printed is varied proportionally to the variable outer diameter while maintaining the outer diameter of the gapless blanket cylinder sleeve constant.

Accordingly, since the size of the blanket is fixed and offset presses presently require changing plates for each job, changes in cutoff are made in a manner similar to today, i.e. plates but not blankets are changed for each job.

Ideally, the residual ink on the blanket, once the image is transferred to the web, is small enough that a secondary image, or ghost image, will not appear on the web. To insure that this doesn't happen, however, the invention also provides for the inclusion of a blanket washer or scrapper, which continually removes the residual ink and recirculates it through the ink train.

BRIEF DESCRIPTION OF THE DRAWINGS

The present invention and its advantages will be more easily understood after reading the following non-restrictive description of preferred embodiments thereof, made with reference to the following drawings, in which.

DESCRIPTION OF A PREFERRED EMBODIMENT OF THE INVENTION

Figure 1A:
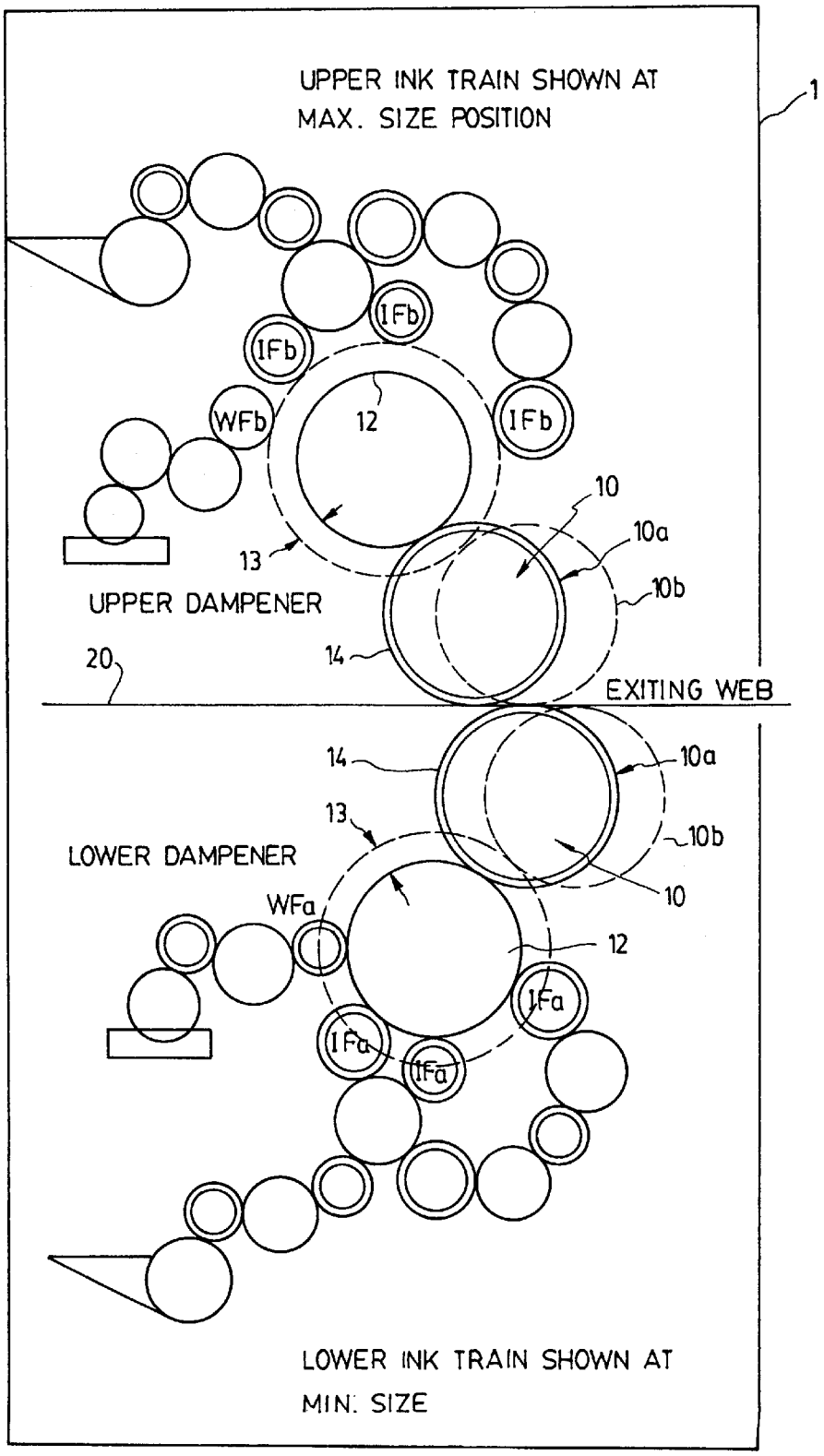
FIG. 1*a* is a cross-sectional view of a portion of a perfecting offset press, from an operator's side, showing a print cylinder having a variable outer diameter printing plate according to a preferred embodiment of the invention.

The invention provides for a variable cutoff web offset printing press unit. A typical offset press has a plate cylinder 12 rotationally and variably mounted on a frame 1 and including a plate cylinder sleeve 13 having an outer circumference mounted about the plate cylinder 12. The press also includes a blanket cylinder 10 rotationally and variably mounted on the frame 1, where the blanket cylinder 10 is parallel to the plate cylinder 12. The blanket cylinder 10 is provided with a gapless blanket cylinder sleeve 14 mounted about the blanket cylinder 10, the gapless blanket cylinder sleeve 14 having a fixed, predetermined outer diameter and an outer circumference. The gapless blanket sleeve 14 contacts the plate cylinder sleeve 13 at a first nip. It should be understood however that other types of gapless blankets will fulfill the objects of the invention.

Figure 4:
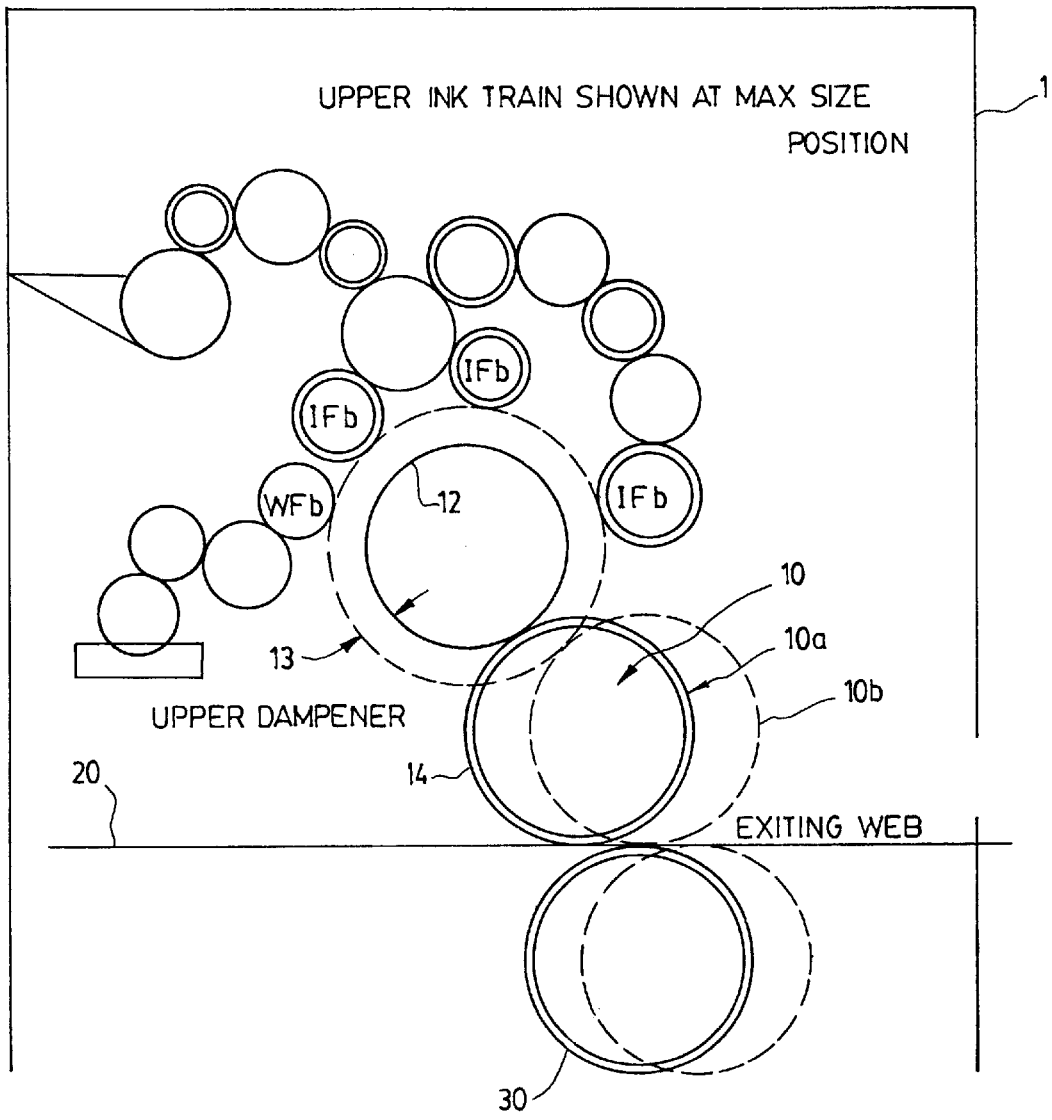
FIG. 4 is a cross-sectional view of a portion of a non-perfecting press.

Means are provided for contacting the gapless blanket sleeve 14 at a second nip, where a material to be printed, sometimes called a web 20, passes through the second nip. In the case of a non-perfecting press, these means take the form of an impression cylinder 30 (shown in FIG. 4). In the case of a perfecting press, as that shown in FIGS. 1*a* and 1*b*, these means take the form of an identical assembly as described above, but which is a mirror image of the assembly about the axis of the web 20. Thus, the perfecting press is provided with another blanket cylinder 10 rotationally and variably mounted on the frame 1. The other blanket cylinder 10 contacts the blanket cylinder 10 of the top assembly at the second nip, and the web 20 passes between the blanket cylinders.

The other blanket cylinder 10 is also provided with another gapless blanket sleeve 14 mounted about the other blanket cylinder 10, the other gapless blanket cylinder sleeve 14 having a fixed, predetermined outer diameter and an outer circumference.

The press also includes another plate cylinder 12 rotationally and variably mounted on the frame 1, also provided with a plate cylinder sleeve 13. The other plate cylinder 12 contacts the other blanket cylinder 10 at a third nip.

Inking means for transferring an ink film to each of the plate cylinder sleeves 13 are also provided, where the ink film is subsequently transferred to the blanket cylinder sleeve 14 at the first nip and, in the case of a perfecting press, also at the third nip, and the ink film is subsequently transferred from the gapless blanket cylinder sleeve 14 to the material to be printed 20 at the second nip.

Since the cylinders rotate at high speed, means 50 to drive in rotation the plate cylinder 12 and means 60 to drive in rotation the blanket cylinder 10 are provided. However, in order that there by no slippage at the first, second and third nips, control means 70 for controlling each of the drive means 50, 60 are also provided so that the surface speed of the sleeve of the plate cylinder 13 and the surface speed of the blanket cylinder sleeve 14 are equal at the first and third (in the case of a perfecting press) nips. It should be also understood that the surface speeds of each of the gapless blanket cylinder sleeves 14 are to be equal at the second nip.

The invention predominantly lies in that the plate cylinder sleeve 13 has a variable outer diameter, whereby a length of an image to be printed is varied proportionally to the variable outer diameter while maintaining the outer diameter of the gapless blanket cylinder sleeve 14 constant.

The size of the plate cylinder 12 is changed by using a sleeve 13 mounted over the plate cylinder 12 or adding packing under the plate 12 to increase the diameter of the plate cylinder. Several approaches are possible without changing the basic concept. The design of the plate 12 can vary from being a cylinder which slides over the sleeve mounted on the plate cylinder and is locked into place by a register pin, to using a sleeve 13 which includes a plate lockup device and accommodates a conventional style plate, the simplest plate lockup device being a slot in the sleeve, into which the leading and trailing edges of the plates are inserted and plate location is established with a registration pin.

Figure 2:
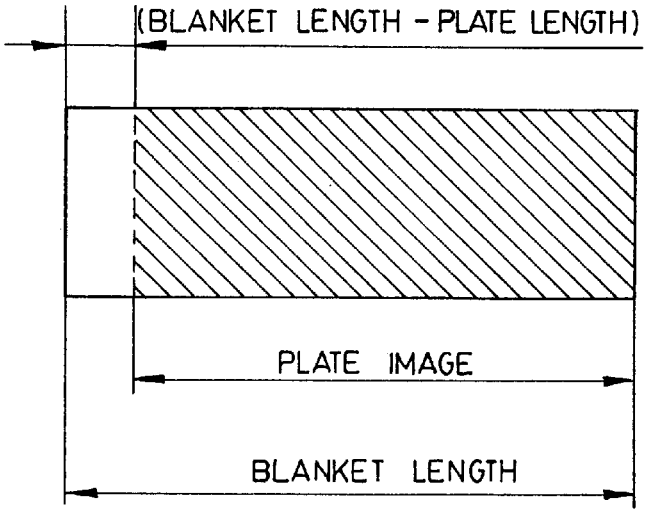
FIG. 2 is a schematic representation of the creeping of an image along the blanket cylinder when the blanket cylinder and the plate cylinder are of different circumference.
Figure 2:
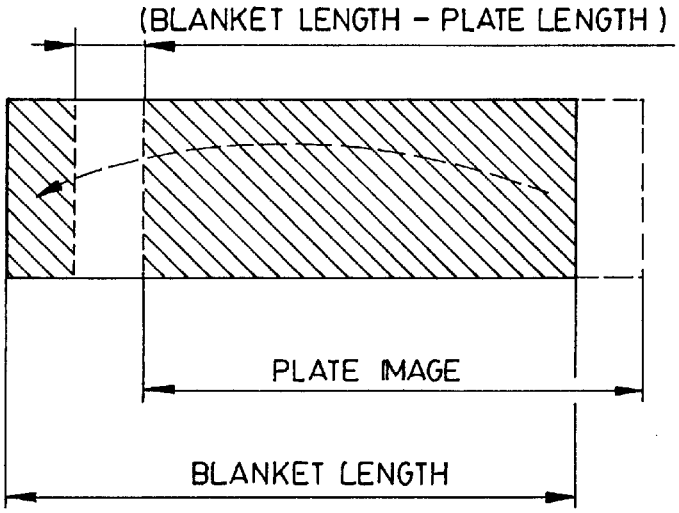

The uniqueness of this approach relates to the fact that the circumference of the blanket 10 and plate 12 cylinders may be of different size as the size of the plate cylinder sleeve 13 or packing is varied. The effect is that when they are of different sizes, the image transferred from the plate to the blanket will "creep" around the blanket cylinder (see FIG. 2). For this reason, a gapless blanket 14 is required for implementation. Otherwise, the resulting image on the paper will have a gap. Referring now to FIG. 2, there is illustrated the "creeping effect" for a press where the blanket length is longer than the plate cylinder length. As can be seen, for the first impression, the image is shorter than the length of the blanket. Consequently, when the second impression occurs, the image will be translated by an amount equal to the difference in length. This "creeping" will repeat itself throughout the printing process for a given plate cylinder length and a given blanket cylinder length.

Figure 1B:
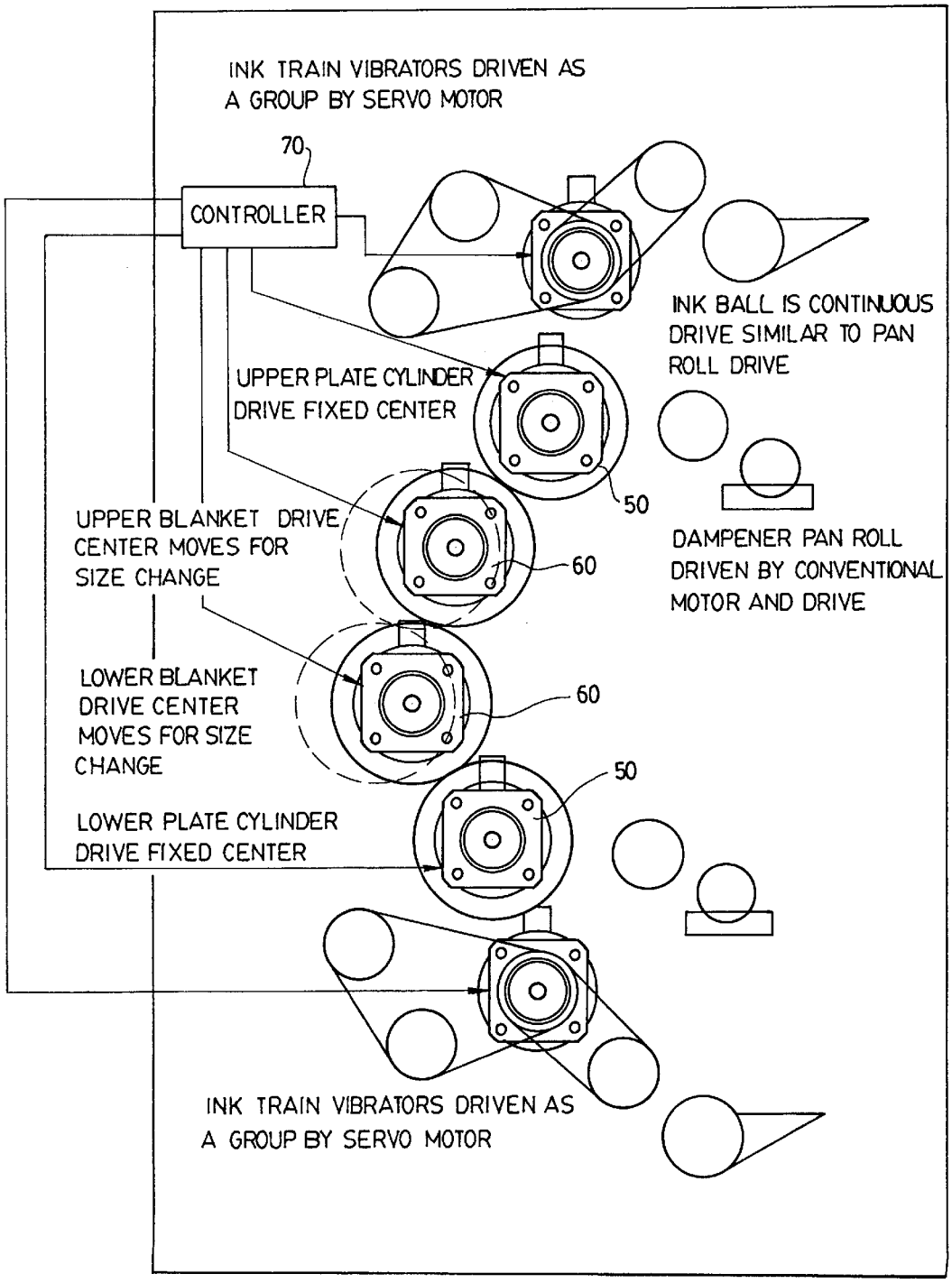
FIG. 1*b* is a cross-sectional view of a portion of a perfecting offset press, from the drive side, showing the use of a network of digital motor drives for controlling and powering the press.

In order to achieve a variation in the size of the plate cylinder sleeve, the preferred embodiment of the invention provides that the plate centers are fixed, requiring only that the location of the blanket cylinders, ink form rolls (ink rolls contacting the plate cylinder sleeve) and water form rolls (dampener rolls contacting the plate cylinder sleeve) are moved to accommodate changes in plate diameter (see FIGS. 1*a* and 1*b*). Eccentrics driven by pneumatic cylinders or other well known techniques, common in the design of printing presses, are used to achieve these movements and maintain settings.

Referring now to FIG. 1*a*, blanket locations corresponding to the minimum plate diameter are represented by reference numerals 10*a* and those corresponding to maximum diameter are represented by reference numerals 10*b*. Ink form rolls for the lower print couple are designated by Ifa and the water form roller is designated as Wfa, and both of these are shown set for the minimum diameter (bottom portion of FIG. 1*a*). Ink form rollers for the upper print couple, designated by Ifb and the water form roller, designated as Wfb, are shown set for the maximum plate diameter (top portion of FIG. 1*a*).

It should be noted that although the stack angles (arrangement of plate and blanket cylinders) are changed in going from one cutoff to another, the impact on print unit dynamics is minimized by the use of a gapless blanket cylinder. Furthermore, changes in web peel-off, resulting from changes in geometry between blankets and the web are minimized by using a blanket cleaner to minimize the amount of residual ink left on the blanket cylinder sleeve.

Figure 3:
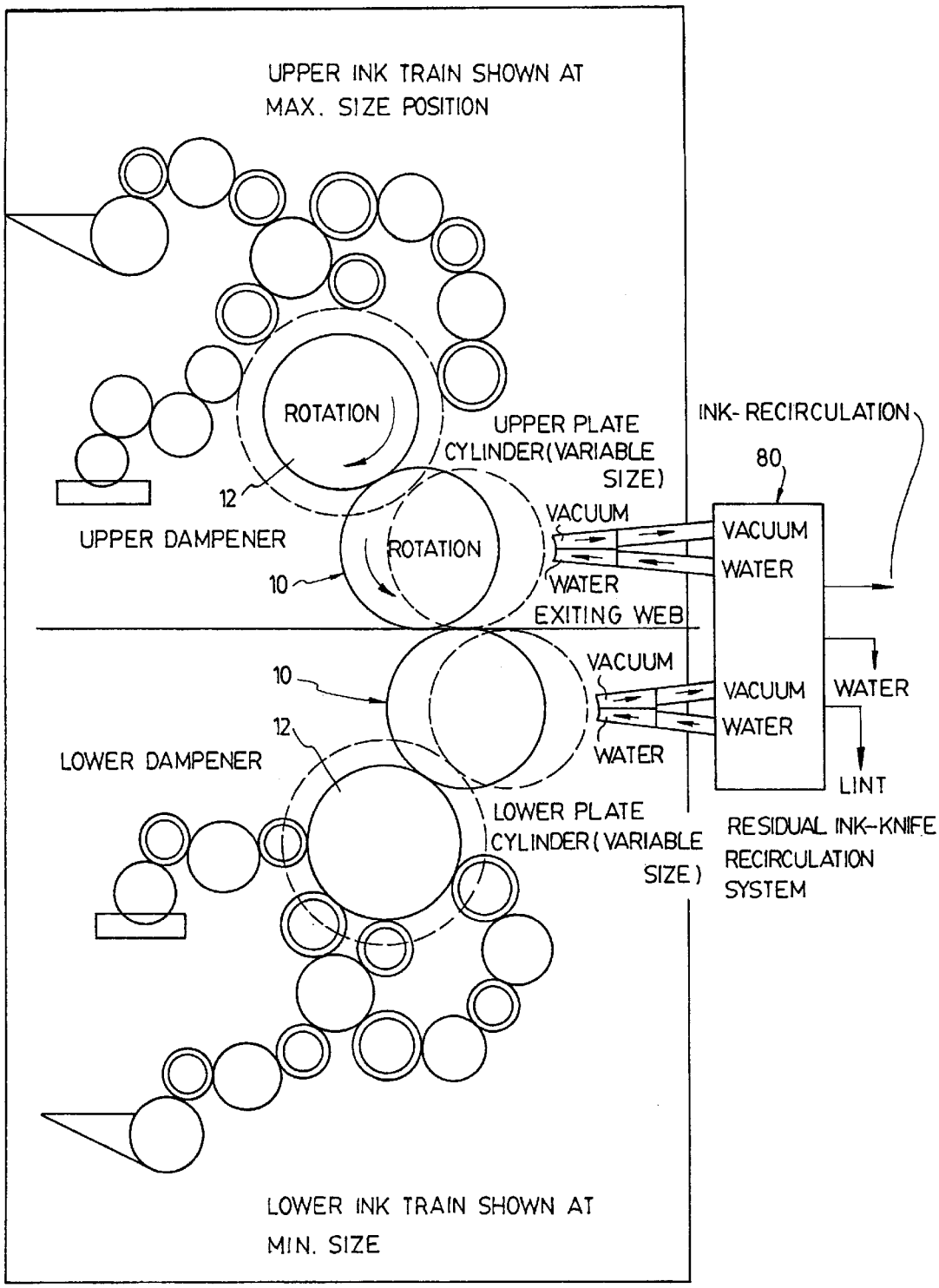
FIG. 3 is a schematic representation of a blanket cleaner/scrapper, for removing residual ink from the blanket cylinder.

The implementation approach is dependent on the ink transfer ratio between the paper and blanket surface. In the preferred implementation, residual ink left on the blanket after initial transfer to the paper is so small, that it does not significantly reduce the quality of the following print impression. An alternative approach includes a mechanism 80 for cleaning the blanket, to remove or reduce the level of residual ink, so that it does not significantly reduce the quality of the following print impression. A device of this type is shown in FIG. 3. One approach uses high pressure water to remove the ink from the cylinder, followed by a low pressure vacuum to remove the combination of ink, water and lint. A filter, reservoir and pump system is included to separate out the lint, ink and water. The ink is then returned to the ink train for future use.

The drives 50, 60 for plate and blanket cylinders are such that the surface speed of the plate and blanket are equal at the point where image transfer takes place. One means of achieving this, shown in FIG. 1*b*, is the use of separate motors to drive plate and blanket cylinders and ink train. The ink ball and dampener are normally driven by conventional motors. Digital electronic drives are currently being used on printing presses for these types of applications. The use of separate drives for blanket cylinders eliminates the need for flexible couplings, gears or other means to accommodate movement of the blanket cylinders. Each of these drives contains an encoder which allows speed and angular position to be measured. Timing belts on the ink drive allow movement of the rollers to be handled with a tensioning device. One example of a product used for these applications is the SYNAX System from Indramat; this drive system can achieve an angular deviation of less than 0.005 degrees.

The master reference for the drives 50, 60 is the surface speed of the plate cylinder with the sleeve mounted thereon. The surface speed can be measured by a sensor directly or calculated from the cylinder RPM and the cylinder diameter. The RPM of the blanket cylinders is inversely proportional to the circumference of the plate cylinder with sleeve, compared to the blanket cylinder with sleeve mounted. For example, if the blanket cylinder with sleeve has a total diameter of 23.5" and the plate cylinder with sleeve has a total diameter of 19.5", the RPM of the blanket will be 0.8298% lower. A secondary control loop can be included in the drive, which measures and controls the torque of the blanket cylinder to eliminate the possibility of slippage between the various cylinders at the nips.

Automatic means are further preferably provided to determine the diameter of the plate cylinder, which are used for speed control and for determining the number of impressions per hour. This will preferably occur in a "calibrate" cycle, where a low inertia roller is placed against the surface of the plate cylinder after the variable sleeve has been mounted thereon. The plate cylinder is driven at low RPM and the surface speed is measured with an encoder attached to the low inertia roller. This reading is used to calculate the diameter of the plate cylinder. Other means such as a transducer on the form rollers or on the blanket, to measure absolute position when the rolls are moved against the plate or a speed sensor on the form roller, could also be used for this "calibration" cycle.

It should be noted that this configuration applies equally well to waterless offset or applications using non traditional inkers such as anilox or ink pumps.

The advantages of fixing the diameter of the blanket cylinders but varying the diameter of the plate cylinder include:

Since blankets are changed when required by wear but not by changes in cutoff, the invention does not considerably modify the ongoing cost of operating offset press, since plates are changed each time a new job is scheduled;

The design of a variable cutoff press according to the invention is simplified, by eliminating the need to change the blanket size;

The present invention reduces or eliminated lint buildup on a blanket due to a "self-cleaning" effect of image rotation on the blanket. Indeed, since the image will not always be at the same location, but rather creeps along the blanket due to the different diameters, the blanket does not need to be cleaned as often because of the buildup of the image on the blanket. This is especially true if the proposed variable cutoff press further includes a blanket cleaner to remove or reduce the residual ink;

The creeping effect of the image on the blanket cylinder will extend the blanket life due to the uniformity of blanket inking resulting from the creeping of the image. This phenomenon is probably further assisted with the inclusion of a blanket cleaner to eliminate residual ink.

Although the present invention has been explained hereinabove by way of a preferred embodiment thereof, it should be pointed out that any modifications to this preferred embodiment within the scope of the appended claims is not deemed to alter or change the nature and scope of the present invention.

I claim:

1. In an offset printing press including:

a plate cylinder rotationally and variably mounted on a frame and including a plate cylinder sleeve having an outer circumference mounted about the plate cylinder;

a gapless blanket rotationally and variably mounted on said frame, where said gapless blanket is parallel to said plate cylinder, said gapless blanket having a predetermined outer diameter and an outer circumference, said gapless blanket contacting said plate cylinder sleeve at a first nip;

means contacting said gapless blanket at a second nip, a material to be printed passing through said second nip;

inking means for transferring an ink film to said plate cylinder sleeve, said ink pattern being subsequently transferred to said gapless blanket at said first nip and said ink pattern being subsequently transferred from said gapless blanket to said material to be printed at said second nip;

means to drive in rotation said plate cylinder;

means to drive in rotation said gapless blanket;

control means for controlling each of said drive means so that the surface speed of the sleeve of said plate cylinder and the surface speed of said gapless blanket are equal at said first nip;

the improvement wherein:

said plate cylinder sleeve has a variable outer diameter, whereby a length of an image to be printed is varied proportionally to said variable outer diameter while maintaining said outer diameter of said gapless blanket constant.

2. An offset press according to claim 1, wherein said gapless blanket comprises a blanket cylinder and a gapless blanket cylinder sleeve mounted about said blanket cylinder.

3. An offset press according to claim 2, wherein said means contacting said gapless blanket cylinder sleeve at said second nip is an impression cylinder rotationally mounted on said frame.

4. An offset press according to claim 2, wherein said means contacting said gapless blanket cylinder sleeve at said second nip is another blanket cylinder, said blanket cylinder being parallel to said blanket cylinder, said blanket cylinder being provided with a gapless blanket cylinder sleeve mounted about the other blanket cylinder, said gapless blanket cylinder sleeve having a fixed outer diameter and circumference, and wherein said press further includes another plate cylinder including a plate cylinder sleeve having an outer diameter mounted about said other plate cylinder, said other plate cylinder contacting said other blanket cylinder at a third nip, said other plate cylinder sleeve also having a variable outer diameter, whereby a length of an image to be printed is varied proportionally to said variable outer diameter while maintaining said outer diameter of said other gapless blanket cylinder sleeve constant;

inking means for transferring an ink film to said other plate cylinder sleeve, said ink pattern being subsequently transferred to said blanket cylinder sleeve at said third nip and said ink pattern being subsequently transferred from said blanket cylinder sleeve to said material to be printed at said second nip;

means to drive in rotation said other plate cylinder;

means to drive in rotation said other blanket cylinder; and wherein said control means also control said means to drive in rotation said other plate cylinder and said means to drive in rotation said other blanket cylinder, whereby both sides of said material to be printed are printed at the same time.

5. An offset press according to claim 4, wherein said gapless blanket cylinder sleeve and said other gapless blanket cylinder sleeve have outer diameters that are equal, and wherein said plate cylinder sleeve and said other plate cylinder sleeve have outer diameters that are equal.

6. An offset press according to claim 2, wherein said offset press further includes an automatic calibration means in order to determine the circumference of said plate cylinder sleeve, said automatic calibration means being operatively connected to said control means.

7. An offset press according to claim 3, wherein said offset press further includes an automatic calibration means in order to determine the circumference of said plate cylinder sleeve, said automatic calibration means being operatively connected to said control means.

8. An offset press according to claim 4, wherein said offset press further includes an automatic calibration means in order to determine the circumference of said plate cylinder sleeve and said other plate cylinder sleeve, said automatic calibration means being operatively connected to said control means.

9. An offset press according to claim 2, wherein said press further includes a blanket cleaner to remove residual ink from said blanket after a complete image has been transferred from said blanket to said material to be printed.

10. An offset press according to claim 3, wherein said press further includes a blanket cleaner to remove residual ink from said blanket after a complete image has been transferred from said blanket to said material to be printed.

11. An offset press according to claim 4, wherein said press further includes a blanket cleaner to remove residual ink from said blanket after a complete image has been transferred from said blanket to said material to be printed and said press further includes another blanket cleaner to remove residual ink from said other blanket after a complete image has been transferred from said other blanket to said material to be printed.

* * * * *